US005234305A

United States Patent [19]

Hotta et al.

[11] Patent Number: 5,234,305

[45] Date of Patent: Aug. 10, 1993

[54] MULTI-STORY PARKING FACILITY

[75] Inventors: Masatoshi Hotta, Nishikasugai; Hideo Kojima, Tokai, both of Japan

[73] Assignee: Sogo Parking Consultants Inc., Japan

[21] Appl. No.: 803,098

[22] Filed: Dec. 5, 1991

[30] Foreign Application Priority Data

Dec. 18, 1990 [JP] Japan ..... 2-403327

[51] Int. Cl.[5] ..... E04H 6/10

[52] U.S. Cl. ..... 414/228; 52/175; 52/176

[58] Field of Search ..... 414/227, 228, 261, 233; 52/174, 175, 176

[56] References Cited

U.S. PATENT DOCUMENTS

| | | | |
|---|---|---|---|
| 688,713 | 12/1901 | Bercuvicy | 52/175 X |
| 1,525,917 | 2/1925 | Cobb | 52/175 |
| 2,565,243 | 8/1951 | Laubscher | 52/176 |
| 2,659,109 | 11/1953 | Burn et al. | 52/175 |
| 2,689,384 | 9/1954 | Burn | 52/175 |
| 2,960,732 | 11/1960 | Khoury | 52/175 |
| 4,035,970 | 7/1977 | Welcker | 52/176 X |
| 4,424,651 | 1/1984 | Lee et al. | 52/175 |
| 4,884,662 | 12/1989 | Cho et al. | 52/174 |

FOREIGN PATENT DOCUMENTS

| | | | |
|---|---|---|---|
| 1325778 | 12/1963 | France | 52/175 |
| 1357684 | 12/1964 | France | 52/175 |
| 203569 | 8/1989 | Japan | 52/175 |
| 140571 | 6/1991 | Japan | 52/175 |
| 4149374 | 5/1992 | Japan | 52/175 |
| 264325 | 1/1927 | United Kingdom | 52/175 |

OTHER PUBLICATIONS

"Double Spiral Auto Ramp", Auto Ramps Corporation, Richmond, Va., Dec. 1929.

*Primary Examiner*—Frank E. Werner
*Assistant Examiner*—James T. Eller, Jr.
*Attorney, Agent, or Firm*—Davis, Bujold & Streck

[57] ABSTRACT

A multi-story parking facility comprises a double helical descending ramp structure in the shape of a rectangle, a pair of ascending ramps located on each side and sandwiching the double helical descending ramp structure therebetween, and a pair of connecting passages provided on each floor for connecting the double helical descending ramp structure and the ascending ramps. The ascending ramps are provided with parking spaces on one or both sides thereof. The pair of connecting passages provided on each floor are positioned symmetrically about the center of the descending ramp structure. The above configuration permits speedy entry and exit of cars to realize a high turnover and accommodation efficiency.

20 Claims, 5 Drawing Sheets

MULTI-STORY PARKING FACILITY

BACKGROUND OF THE INVENTION

The present invention relates to a parking facility. More particularly, the present invention relates to a multi-story parking facility which can efficiently accommodate more than 1,000 cars.

Various studies show that approximately 600 cars per hour at most, (i.e., one car per 6 seconds) can drive through an entrance or an exit of a parking facility. This is because motorists have to receive and return their parking tickets at the entrances and exits. A public or shopping center's parking facility is preferably capable of a complete turnover of accommodated cars within 1.5 hours during rush hours. This means that a parking facility having a capacity of 600 cars should be able to cope with approximately 1,000 entering or exiting cars within 1.5 hours. Therefore, to realize this objective of a complete turnover within 1.5 hours, a parking facility with a capacity of 600 cars requires two entrances and two exits.

However, even if a parking facility, which can accommodate more than 1,000 cars, is provided with two pairs of entrances and exits, the exit passages tend to become bottlenecks delaying the departure of the cars and lowering the turnover efficiency of the facility.

SUMMARY OF THE INVENTION

An object of the invention is to provide a multi-story parking facility having a capacity of more than 1,000 cars and two entrances and two exits which permits cars to rapidly exit realizing a high turnover efficiency.

A multi-story parking facility of the present invention, constructed to overcome the above-identified problems, comprises a double helical descending ramp structure that is approximately rectangular, the double helical descending ramp structure comprising two descending ramps, whereby one complete revolution thereof descends two floor levels, two rectangular ascending ramps provided on two longitudinal sides of the double helical descending ramps, whereby one complete revolution thereof ascends one floor level, a pair of ascending parking lots comprising parking spaces connected to one or both sides of the ascending ramps, a first connecting passage provided on each floor of the multi-story parking facility for connecting one of the ascending ramps with one descending ramp of the double helical descending ramp structure on each floor, and a second connecting passage provided on each floor of the multi-story parking facility for connecting the other ascending ramp with the other descending ramp of the double helical descending ramp on each floor, the first and the second connecting passages being positioned on a diagonal of the double helical descending ramp structure at the same height.

On each floor of the parking facility, the first connecting passage connects one of the two ascending parking ramps with one of the descending ramps of the double helical descending ramp structure which is sandwiched between the two ascending parking ramps. The second connecting passage connects the other ascending parking ramp with the other descending ramp of the double helical descending ramp structure. A car parked in one of the parking spaces provided on one or both sides of the ascending ramps can leave the parking facility via the descending ramp structure by taking whichever one of the two connecting passages is more convenient. This allows cars to rapidly exit the parking facility. Furthermore, one complete revolution around the double helical descending ramp structure brings a car down by two stories, thereby reducing the time required to leave the parking facility.

BRIEF EXPLANATION OF THE ATTACHED DRAWINGS

DETAILED DESCRIPTION OF THE INVENTION

Figure 1:
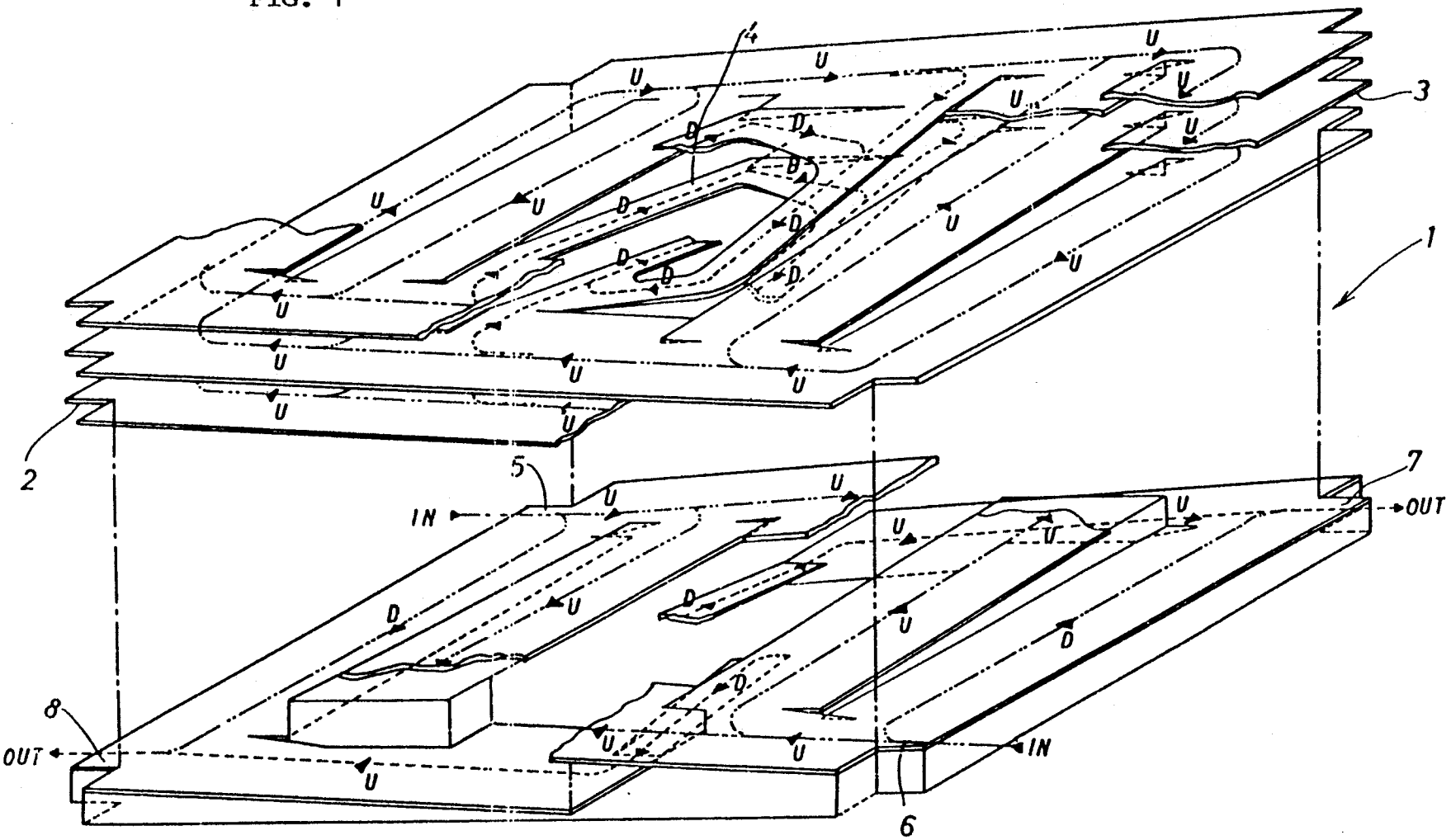
FIG. 1 is a partially cutaway perspective view of a multi-story parking facility of the present invention.

A preferred embodiment of the invention will now be explained with specific reference to the attached drawings.

In the Figures, there is indicated at 1 a multi-story parking facility having approximately a rectangular shape. The parking facility 1 comprises a pair of rectangular ascending parking ramps 2 and 3 spaced apart from each other and a double helical descending ramp structure 4 provided between, and integrally connected to, the ascending parking ramps 2 and 3. The ascending ramps 2 and 3 are connected to the double helical descending ramp structure 4 adjacent the long sides of the parking facility. The ascending parking ramps 2 and 3 comprise a passage 2*a* and a passage 3*a*, respectively, and 90-degree-angle parking spaces 21 and diagonal-angle parking spaces 22 provided on one or both sides thereof. The passages 2*a* and 3*a* comprises short passages $2a_1$ and $3a_1$ and long passages $2a_2$ and $3a_2$, respectively. The ascending parking ramps 2 and 3 are connected with each other via the double helical descending ramp structure 4 on each floor. One complete revolution of the ascending parking ramp 2 or 3 brings a car up by one story. On the other hand, a car goes up by two stories by taking one complete revolution of the outer sides of the ascending parking ramps 2 and 3, (i.e., by following the perimeter of the walls defining the outline of the facility). The double helical ramp structure 4 extends around and upwardly to form a well 20 which allows ventilation. It may be noted that in the Figures, UP or U indicates ascending ramps, while DN or D indicates descending ramps.

Figure 2:
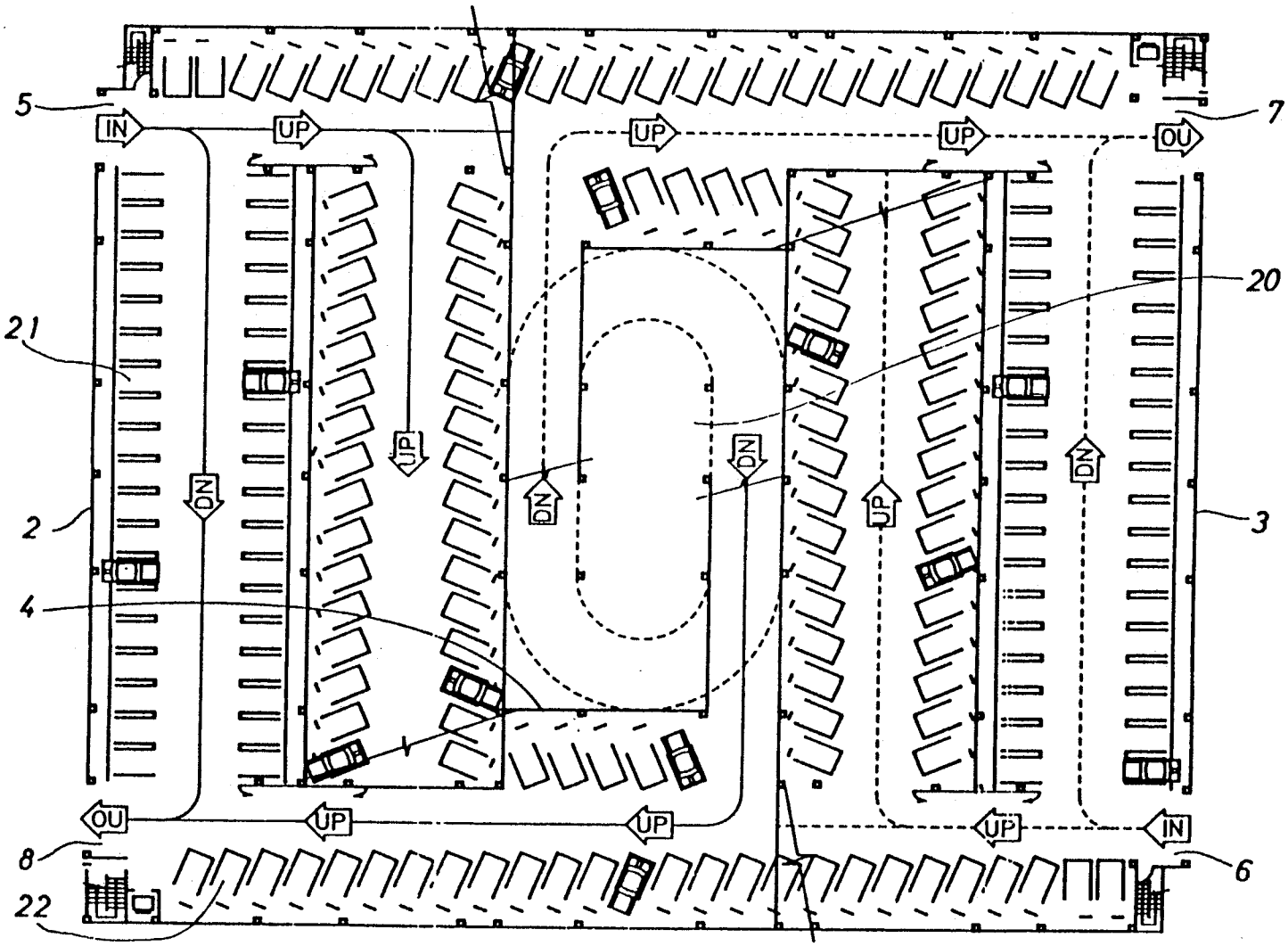
FIG. 2 is a plan view of the first floor of the multi-story parking facility according to the present invention.

As shown in FIGS. 1 and 2, the parking facility 1 is provided with two entrances 5 and 6 adjacent to two diagonal corners and two exits 7 and 8 adjacent the two remaining diagonal corners. Cars are parked at a diagonal parking angle on the first floor except on both sides of the outer passages along the shorter side walls where cars are parked at a 90 degree parking angle.

Figure 3:
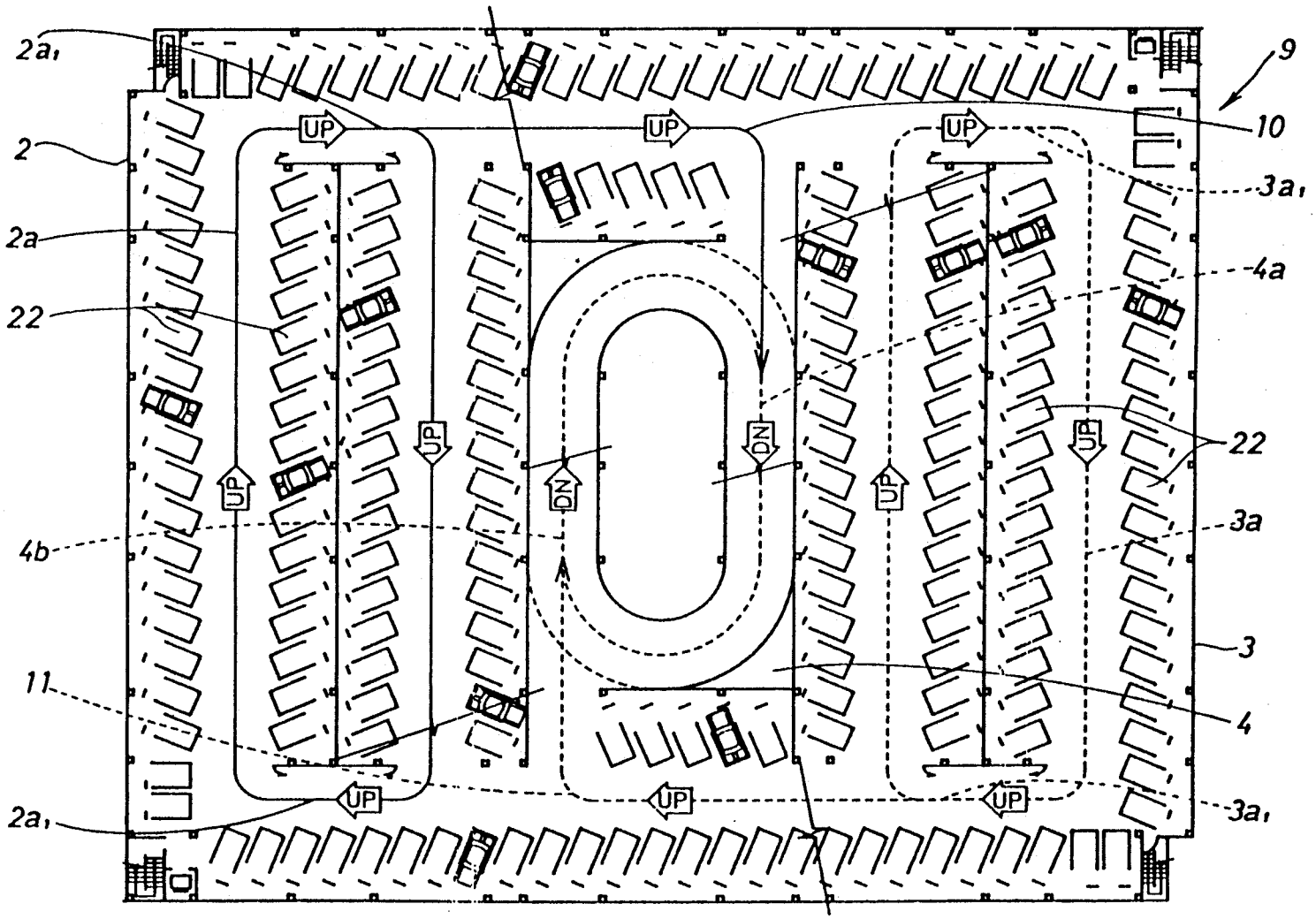
FIG. 3 is a plan view of a standard floor of the multi-story parking facility according to the present invention.

As shown in a plan view of a standard floor 9 of FIG. 3, parking spaces 22, where cars are parked at a diagonal parking angle, are provided on the both sides of rectangular passages 2*a* and 3*a*. One of short passages $2a_1$ of the passage 2*a* is connected to a ramp 4*a* of the double helical descending ramp structure 4 via a connecting passage 10 where cars turn right to enter the ramp 4*a*, and is also connected to one of short passages $3a_1$ of the passage 3*a* via the connecting passage 10. Likewise, one of short passages $3a_1$ is connected to a ramp 4*b* of the double helical ramp structure 4 via a connecting passage 11 and is also connected to one of short passages $2a_1$ via the connecting passage 11. The connecting passages 10 and 11 are positioned symmetrically at the same height about the center of the well 20.

Figure 4:
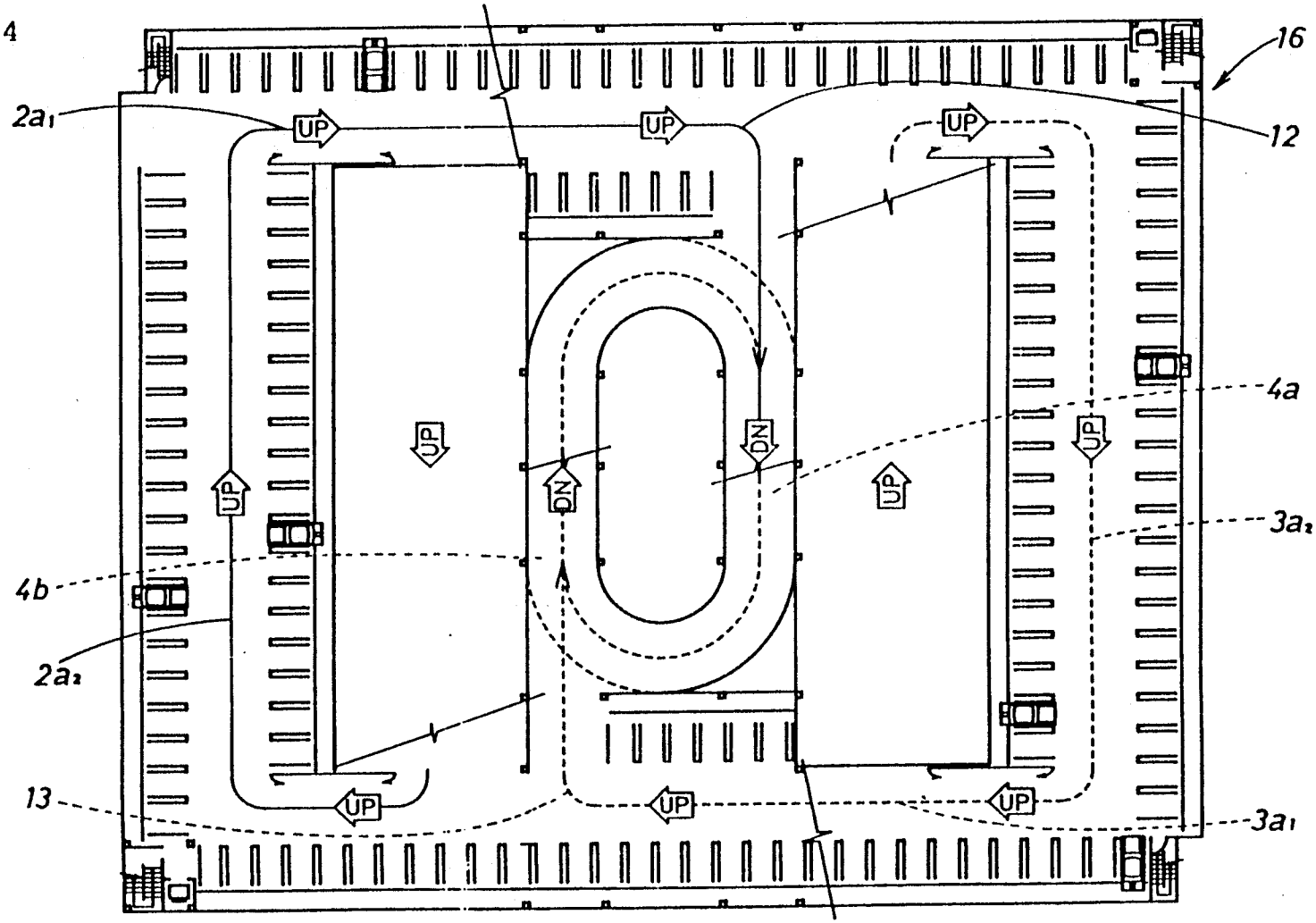
FIG. 4 is a plan view of the top floor of the multi-story parking facility according to the present invention.

As shown in a plan view of a top floor of FIG. 4, only one of the long passages $2a_2$ and the long passages $3a_2$, the outer ones, are provided on this floor. One of the short passages $2a_1$ is connected to the ramp 4*a* of the double helical descending ramp structure 4 via a connecting passage 12 while one of the short passages $3a_1$ is connected to the ramp 4*b* of the double helical descending ramp structure 4 via a connecting passage 13. The connecting passages 12 and 13 are positioned symmetrically at the same height about the center of the well 20.

Figure 5:
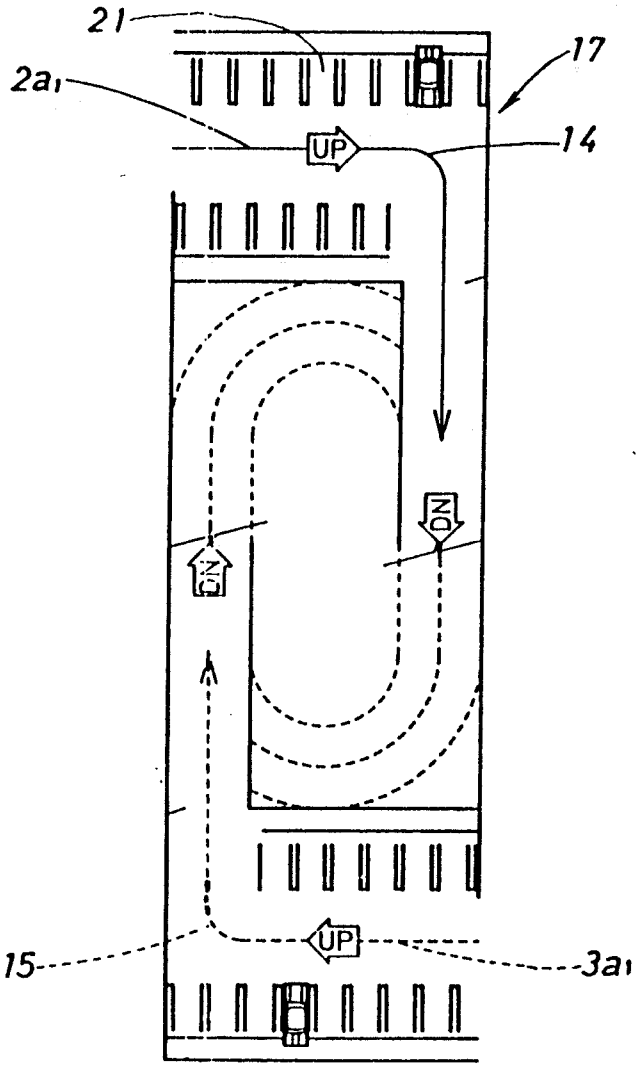
FIG. 5 is a plan view of the roof of the multi-story parking facility according to the present invention.

As shown in a plan view of a roof of FIG. 5, the traffic reaching the roof can turn only right at connecting passages 14 or 15 and enter the ramps 4*a* or 4*b*. Ninety degree parking spaces 21 are provided on both sides of the long passages $2a_1$ and $3a_1$ on the roof.

Although the flow of the traffic shown in the embodiment is clockwise, the traffic may be counterclockwise by changing the arrangement of the entrances 5 and 6 and exits 7 and 8. Cars enter the multi-story parking facility 1 at entrances 5 or 6 and go upwardly and around clockwise looking for a vacancy in the parking spaces 21 or 22 in this embodiment. Cars leave the parking facility 1 at the exits 7 or 8 after descending ramps 4*a* or 4*b*. Making one complete revolution of either of the ramps 4*a* or 4*b* brings a car down by two stories. A car leaving via a connecting passage on an odd-numbered floor, such as the third floor, will take the exit on the same side as the entrance at which the car entered the parking facility 1. A car leaving via a connecting passage on an even-numbered floor, such as the second floor, will take the exit on the opposite side to the entrance at which it entered the parking facility 1. The traffic in both outer long passages on the first floor flows in the opposite direction to that on the standard floor and the higher floors.

Even if one of the ascending parking ramps 2 or 3 is full, cars looking for a vacancy in the parking spaces 21 or 22 can be guided to the other ascending ramp by a call signal because the ramps 2 and 3 are connected with each other. However, it takes approximately 15 seconds to steer a car over to the other ramp, which may cause traffic congestion. To avoid congestion, diagonal parking angle spaces are generally favored on lower floors while 90 degree parking spaces are favored on higher floors. Ninety degree parking angle spaces are provided on the both sides of the outer long passages on the shorter sides of the first floor in the embodiment because traffic is relatively light in these areas.

Since there may be various modifications and changes without departing from the scope of the invention, the embodiments described above are not intended to limit the invention to these embodiments but are intended to illustrate the invention more clearly.

Being constructed as described above, the present invention allows the cars to speedily enter and depart from a parking facility having a capacity over 1,000 cars, hence raising the accommodation/turnover efficiency of the parking facility.

What is claimed is:

1. A multi-story parking facility, having a plurality of floors, comprising:

a double helical descending ramp structure comprising two separate descending ramps in which each descending ramp descends a vehicle by two floors upon one complete revolution on the descending ramp;

two ascending ramps provided on two opposite sides of the double helical descending ramp structure in which each ascending ramp ascends a vehicle one floor upon one complete revolution on the ascending ramp;

a plurality of parking spaces located on at least one side of a traffic path defined by each ascending ramp;

a first connecting passage provided on each floor of the multi-story parking facility for connecting one of the ascending ramps with one of the descending ramps; and a second connecting passage provided on each floor of the multi-story parking facility for connecting the other ascending ramp with the other descending ramp, the first and second connecting passages being located at the same height and diagonally with respect to one another with the double helical descending ramp structure located therebetween.

2. A multi-story parking facility, having a plurality of floors, comprising:

a double helical descending ramp structure being substantially rectangular in shape, said double helical descending ramp structure comprising two separate descending ramps, whereby each complete revolution of one of the descending ramps descends a vehicle by two floors;

two substantially rectangular ascending ramps provided on opposite longitudinal sides of the double helical descending ramps, whereby each complete revolution on one of the ascending ramps ascends a vehicle by one floor;

a plurality of parking spaces located on at least one side of a traffic path defined by each ascending ramp;

a first connecting passage provided on each floor of the multi-story parking facility for connecting one of the ascending ramps with one of the descending ramps of the double helical descending ramp structure; and a second connecting passage provided on each floor of the multi-story parking facility for connecting the other ascending ramp with the other descending ramp of the double helical descending ramp, the first and second connecting passages being located at substantially the same height and diagonally with respect to one another with the double helical descending ramp structure therebetween.

3. A multi-story parking facility as in claim 2, wherein the multi-story parking facility has at least 1,000 parking spaces.

4. A multi-story parking facility as in claim 2, wherein the multi-story parking facility has two entrances and two exits.

5. A multi-story parking facility as in claim 2, wherein the double helical descending ramp structure descends in one of a clockwise direction and a counter-clock direction.

6. A multi-story parking facility as in claim 5, wherein said parking spaces comprise a plurality of diagonal parking spaces and a plurality of perpendicular parking spaces.

7. A multi-story parking facility as in claim 2, wherein the two rectangular ascending ramps ascend in one of a clockwise direction and a counter-clock direction.

8. A multi-story parking facility as in claim 7, wherein said parking spaces comprises a plurality of diagonal parking spaces and a plurality of perpendicular parking spaces.

9. A multi-story parking facility as in claim 2, wherein the first and second connecting passages are provided with diagonal parking spaces.

10. A multi-parking facility as in claim 2, wherein the first and second connecting passages are provided with perpendicular parking spaces.

11. A multi-parking facility as in claim 2, wherein one complete revolution of a vehicle about an exterior perimeter traffic path of the multi-story parking facility, along a portion of each of the two ascending ramps, ascends the vehicle by two floors.

12. A multi-story parking facility as in claim 2, wherein each said rectangular ascending ramp comprises a plurality of opposed short passages and a plurality of opposed long passages, and each of said long and short passages are provided with a plurality of parking spaces on either side thereof.

13. A multi-story parking facility as is claimed in claim 12, wherein said plurality of parking spaces comprise a plurality of diagonal parking spaces and a plurality of perpendicular parking spaces.

14. A multi-story parking facility as is claimed in claim 2, wherein an end of each ascending ramp is connected with a beginning of one descending ramp by a pair of diagonally located connecting passages.

15. A multi-story parking facility as is claimed in claim 2, wherein parking floors adjacent ground level generally contain diagonal parking spaces and parking floors remote from ground level generally contain perpendicular parking spaces.

16. A multi-story parking facility, having a plurality of floors and at least 1,000 parking spaces, comprising:

a double helical descending ramp structure comprising two separate descending ramps in which each descending ramp descends a vehicle by two floors upon one complete revolution on the descending ramps;

two ascending ramps provided on two opposite sides of the double helical descending ramp structure in which each ascending ramp ascends a vehicle by one floor upon one complete revolution on the ascending ramp;

a plurality of parking spaces located on at least one side of a traffic path defined by each ascending ramp;

a first connecting passage provided on each floor of the multi-story parking facility for connecting one of the ascending ramps with one of the descending ramps; and a second connecting passage provided on each floor of the multi-story parking facility for connecting the other ascending ramp with the other descending ramp, the first and second connecting passages being located at substantially the same height and diagonally with respect to one another with the double helical descending ramp structure located therebetween, and the multi-story parking facility having two entrances and two exits with the double-helical descending ramp structure descending and the ascending ramps ascending in the same direction.

17. A multi-story parking facility as in claim 16, wherein one complete revolution of a vehicle about an exterior perimeter traffic path of the multi-story parking facility, along a portion of each of the two ascending ramps, ascends the vehicle by two floors.

18. A multi-story parking facility as in claim 17, wherein each said ascending ramp is rectangularly shaped and comprises a plurality of opposed short passages and a plurality of opposed long passages, and each of said long and short passages are provided with a plurality of parking spaces on either side thereof.

19. A multi-story parking facility as is claimed in claim 18, wherein an end of each ascending ramp is connected with a beginning of one descending ramp by a pair of diagonally located connecting passages.

20. A multi-story parking facility as is claimed in claim 19, wherein parking floors adjacent ground level generally contain diagonal parking spaces and parking floors remote from ground level generally contain perpendicular parking spaces.

* * * * *